US007375638B2

(12) United States Patent
Light et al.

(10) Patent No.: US 7,375,638 B2
(45) Date of Patent: May 20, 2008

(54) ELECTRONIC TETHER FOR PORTABLE OBJECTS

(75) Inventors: Elliott D. Light, Rockville, MD (US); Brian Boesch, Oak Hill, VA (US); Jon L. Roberts, Great Falls, VA (US)

(73) Assignee: Robelight, LLC, Great Falls, VA (US)

( * ) Notice: Subject to any disclaimer, the term of this patent is extended or adjusted under 35 U.S.C. 154(b) by 157 days.

(21) Appl. No.: 11/360,061

(22) Filed: Feb. 23, 2006

(65) Prior Publication Data

US 2006/0197658 A1 Sep. 7, 2006

Related U.S. Application Data

(60) Continuation-in-part of application No. 10/911,018, filed on Aug. 4, 2004, now Pat. No. 7,042,360, which is a continuation-in-part of application No. 10/832,498, filed on Apr. 27, 2004, now Pat. No. 7,064,669, which is a continuation-in-part of application No. 09/591,167, filed on Jun. 9, 2000, now Pat. No. 6,748,902, and a continuation-in-part of application No. 10/078,890, filed on Feb. 19, 2002, now abandoned, which is a division of application No. 09/591,167, filed on Jun. 9, 2000, now Pat. No. 6,748,902.

(51) Int. Cl.
*G08B 13/14* (2006.01)

(52) U.S. Cl. ..... 340/572.4; 340/572.1; 340/573.1

(58) Field of Classification Search ..... 340/572.1, 340/572.4, 568.1, 571, 573.1, 573.3, 573.4, 340/573.7, 539.11, 539.13, 539.15, 539.21, 340/539.23, 10.34

See application file for complete search history.

(56) References Cited

U.S. PATENT DOCUMENTS

| | | | | |
|---|---|---|---|---|
| 4,335,682 | A | 6/1982 | Gonda et al. | |
| 4,675,656 | A * | 6/1987 | Narcisse | 340/539.21 |
| 4,802,482 | A | 2/1989 | Gonda et al. | |
| 4,898,120 | A | 2/1990 | Brose | |
| 5,054,428 | A | 10/1991 | Farkus | |

(Continued)

OTHER PUBLICATIONS

Rob Harrill, "A watch that's smarter than you?", http://www.eurekalert.org/pub_releases/2004-10/uow-awt100604.php, Oct. 6, 2004.

(Continued)

*Primary Examiner*—Van T. Trieu
(74) *Attorney, Agent, or Firm*—Roberts Mardula & Wertheim, LLC

(57) ABSTRACT

A system and method for issuing an alarm when the separation distance between a monitoring module associated with an object (animate or inanimate) and an alert module exceeds a preset threshold distance thereby forming a leadless electronic tether between the object and the object owner. A monitoring module comprises a portable transmitter provides a signal to an alert module comprising a receiver and a processor. The alert module is adapted to determine a separation distance between the monitoring module and the alert module based on an attribute of the signal. When the separation distance exceeds a predetermined threshold, the alert module issues an alert. Alternatively, when the monitoring module signal is not received by the alert module, an alert is issued.

43 Claims, 7 Drawing Sheets

U.S. PATENT DOCUMENTS 5,067,441 A 11/1991 Weinstein
5,075,670 A * 12/1991 Bower et al. ..... 340/573.4
5,204,657 A 4/1993 Prosser et al.
5,223,815 A * 6/1993 Rosenthal et al. ..... 340/539.21
5,353,744 A 10/1994 Custer
5,381,129 A 1/1995 Boardman
5,425,330 A 6/1995 Touchton et al.
5,461,365 A 10/1995 Schlager et al.
5,465,687 A 11/1995 Custer
5,477,210 A 12/1995 Belcher
5,553,469 A 9/1996 Seidel
5,605,116 A 2/1997 Kim et al.
5,638,050 A 6/1997 Sacca et al.
5,642,690 A 7/1997 Calabrese et al.
5,648,757 A 7/1997 Vernace et al.
5,686,891 A 11/1997 Sacca, Jr. et al.
5,781,102 A 7/1998 Huang
5,790,021 A 8/1998 Mickel et al.
5,844,489 A 12/1998 Yarnall et al.
5,857,433 A 1/1999 Files
5,868,100 A 2/1999 Marsch
5,870,973 A 2/1999 Touchton et al.
5,939,988 A * 8/1999 Neyhart ..... 340/573.4
5,977,913 A 11/1999 Christ
6,011,471 A 1/2000 Huang
6,019,066 A 2/2000 Taylor
6,047,664 A 4/2000 Lyerly
6,064,308 A 5/2000 Janning et al.
6,075,443 A 6/2000 Schepps et al.
6,131,535 A 10/2000 So
6,135,060 A 10/2000 So
6,151,276 A * 11/2000 Peinetti ..... 367/139
6,155,208 A 12/2000 Shell et al.
6,163,261 A 12/2000 Westrick
6,166,635 A 12/2000 Huang
6,166,643 A 12/2000 Janning et al.
6,167,843 B1 1/2001 Kim
6,170,439 B1 1/2001 Duncan et al.
6,184,790 B1 2/2001 Gerig
6,191,693 B1 2/2001 Sangsingkeow
6,230,661 B1 5/2001 Yarnall, Jr. et al.
6,369,710 B1 * 4/2002 Poticny et al. ..... 340/572.1
6,405,132 B1 6/2002 Breed et al.
6,412,813 B1 7/2002 Breed et al.
6,529,131 B2 3/2003 Wentworth
6,577,238 B1 6/2003 Whitesmith et al.
6,600,422 B2 7/2003 Barry et al.
6,674,364 B1 1/2004 Holbrook et al.
6,686,881 B1 2/2004 Lu et al.
6,687,609 B2 2/2004 Hsiao et al.
6,714,133 B2 * 3/2004 Hum et al. ..... 340/573.4
6,720,920 B2 4/2004 Breed et al.
6,820,897 B2 11/2004 Breed et al.
6,825,754 B1 * 11/2004 Rolin ..... 340/10.34
6,837,427 B2 1/2005 Overhultz et al.
6,917,291 B2 7/2005 Allen et al.
7,005,985 B1 * 2/2006 Steeves ..... 340/572.1
2002/0198632 A1 12/2002 Breed et al.
2003/0233189 A1 12/2003 Hsiao et al.

OTHER PUBLICATIONS

Suresafe Technology Inc. Product Description, http://www.suresafe.com, Feb. 8, 2005.
TrackIT Corp. Product Description; "Mobile Security Goes High Tech", http:www/trackitcorp.com, Feb. 8, 2005.

* cited by examiner

ELECTRONIC TETHER FOR PORTABLE OBJECTS

CROSS REFERENCE TO RELATED APPLICATIONS

This application is a continuation-in-part of application Ser. No. 10/911,018 filed Aug. 4, 2004, now U.S. Pat. No. 7,042,360, which is a continuation-in-part of application Ser. No. 10/832,498, filed Apr. 27, 2004, now U.S. Pat. No. 7,064,669, which is a continuation in part application of application Ser. No. 09/591,167, filed Jun. 9, 2000, now U.S. Pat. No. 6,748,902, and a continuation in part of application Ser. No. 10/078,890 filed Feb. 19, 2002, now abandoned which is a divisional application of application Ser. No. 09/591,167, filed Jun. 09, 2000, now U.S. Pat. No. 6,748, 902. The Ser. No. 10/911,018, the Ser. No. 10/832,498, the Ser. No. 10/078,890 and the Ser. No. 09/591,167 applications are incorporated herein by reference in their entirety for all purposes.

BACKGROUND

This invention relates generally to monitoring animate and inanimate objects. More particularly the present invention is a form of electronic leash for animals, an electronic tag for people, and an electronic "tether" for portable objects carried by individuals.

Finding an object requires there be some perception that the object is missing. In the case of valuable objects, the delay in perception may be costly. How many times does a person notice many hours later, that a purse or other object has been left at a store or restaurant? By that time, the object may be out of range of the finding device, either because the owner has left the vicinity of the object or the object has been removed from the vicinity of the owner.

"Electronic tethers" have been proposed using a variety of technology. The most common system uses a monitoring module and an alert module. In this system, the monitoring module comprises a transmitter. The alert module receives a signal from the monitoring module and determines the distance between the alert module and the monitoring module. When a predetermined distance is exceeded, the alert module issues an alarm. Variations of this system add a transmitter in the monitoring module to allow the alert module to poll the monitoring module and to react when the monitoring module fails to respond.

In co-owned U.S. application Ser. No.: 10/911,018, an "electronic tether" is described that uses an RFID tag as the monitoring module. The alert module comprises an RFID polling system. The system issues an alert when an RFID tag fails to respond to a polling signal.

In co-owned U.S. application Ser. No.: 10/832,498, an "electronic tether" is described that uses an audio signal as a polling signal. The monitoring module and the alert module each have a clock that is synchronized to a common time. The distance between the alert module and the monitoring module is determined by the propagation time of an audio signal sent by the monitoring module to the alert module.

What would be truly useful would be a system that comprises an "electronic leash" or "electronic tether" which can be variably preset by an animal owner or object owner and operated so as to prevent the animal, person or object from becoming separated from its owner. Such a system would further be capable of identifying a specific animal, person, or object that is missing from a group of monitored animals or objects. Without meaning any disparagement, this application shall refer to people, animals and objects collectively as objects. Similarly, the term "owner" as used herein is synonymous with owner, parent, caregiver and the like.

SUMMARY

Embodiments of the present invention provide systems and methods for issuing an alarm when the separation distance between a monitoring module associated with an object (animate or inanimate) and an alert module exceeds a preset threshold distance thereby forming an electronic tether between the object and the object owner.

It is therefore an aspect of the present invention to issue an alert to an object owner when the owner leaves an object behind.

It a further aspect of the present invention to issue an alert to an object owner when the object is separated from the object owner.

It is yet another aspect of the present invention to form an electronic tether between an owner of one or more objects and the objects without the need for a physical connection between the owner and the objects.

These and other aspects of the present invention will become apparent from the general and detailed descriptions that follow.

The present invention comprises an electronic tether comprising an alert module and a monitoring module. The monitoring modules (signal sources) are minimally sized so they can be attached, placed inside or incorporated into a variety of objects such as PDA's cell phones, pagers, camera bags, purses, diaper bags, key chains, backpacks, etc. Each monitoring module comprises an addressable signal generator. By way of illustration and not as a limitation, the signal generator may produce an RF signal, an audio signal, or a magnetic field signal. The signal generator address may be preset or settable using means known in the art. The signal generator address associates the signal generator in the monitoring module with a monitored device in the alert module. An alternative embodiment of the present invention employs radio frequency identification (RFID) tags to give rise to the functionality described herein.

In an embodiment of the present invention, when a monitoring module is first powered on, the alert module "learns" the signal generator address using means known in the art. By way of example and not as a limitation, a monitored device on the owner alert device is selected and the monitoring module is placed in close proximity to the owner alert device. A "learn" button is pressed on the owner alert device and the address of the signal generator is saved and associated with the selected monitored device. Thereafter, when the owner leaves the area in which a monitored device is located, an alert is generated to the owner, which may be audible, visual, or tactile (as in the case of a vibrating device) to tell the owner he/she has left the monitored object behind. Corrective action to retrieve the device can then be taken. Similarly, if a monitored device is surreptitiously taken (as in a stolen handbag or camera), the increasing distance from the owner will cause an alert to be given to the owner to potentially thwart any theft.

DETAILED DESCRIPTION

Embodiments of the present invention provide systems and methods for issuing an alarm when the separation distance between a monitoring module associated with an object (animate or inanimate) and an alert module exceeds a preset threshold distance thereby forming a leadless electronic tether between the object and the object owner.

The Ser. No. 09/591,167 application (now U.S. Pat. No. 6,748,902) as incorporated herein by reference describes an animal training device comprising a power supply and a microprocessor. The microprocessor comprises processing capability and storage of variable parameters. The variable parameters are input by a variable setting means that can be a dial, digital setting or other types of setting means known in the art. When the trainer desires to set a specific radius distance, such as a distance in input in the variable setting thus providing instructions to the processor. Once the processor receives settings on the desired radius distance, the signal is sent to the transmitter to apply the appropriate power to the transmission as instructed by the processor. A signal is then transmitted that can be received by an animal device. Depending upon the radius distance set by the trainer, the transmitted signal will be stronger or weaker as desired.

The animal device is a self-contained unit that is worn on a collar or other attachment to the animal. The animal device receives the signal from the training device via an antenna. The antenna is connected to an internal receiver that has the capability of receiving and evaluating the signal strength so that the signal strength can be determined. Once the signal strength is determined it is provided to a logical elements in the animal device. The logical elements, which may be in the form of digital or analogue circuitry, interprets the signal strength and, depending upon the level of the signal strength, sends a signal to an audible alarm which in turn powers a speaker that provides an audible signal to the animal when the signal strength is at some intermediate or warning level.

In an alternative embodiment presented in the Ser. No. 09/591,167 application (now U.S. Pat. No. 6,748,902) the variable setting is established by virtue of setting a radius distance on the animal device rather than on the training device. In this embodiment, the training device architecture is simplified by eliminating the variable power setting in the transmitter. This embodiment of the training device comprises a power supply connected to a transmitter and an antenna.

The present invention utilizes an embodiment of the animal device (comprising a receiver) as an alert module and the simplified training device (comprising a signal generator) as the monitoring module. Together, these components provide an electronic tether.

Figure 1:
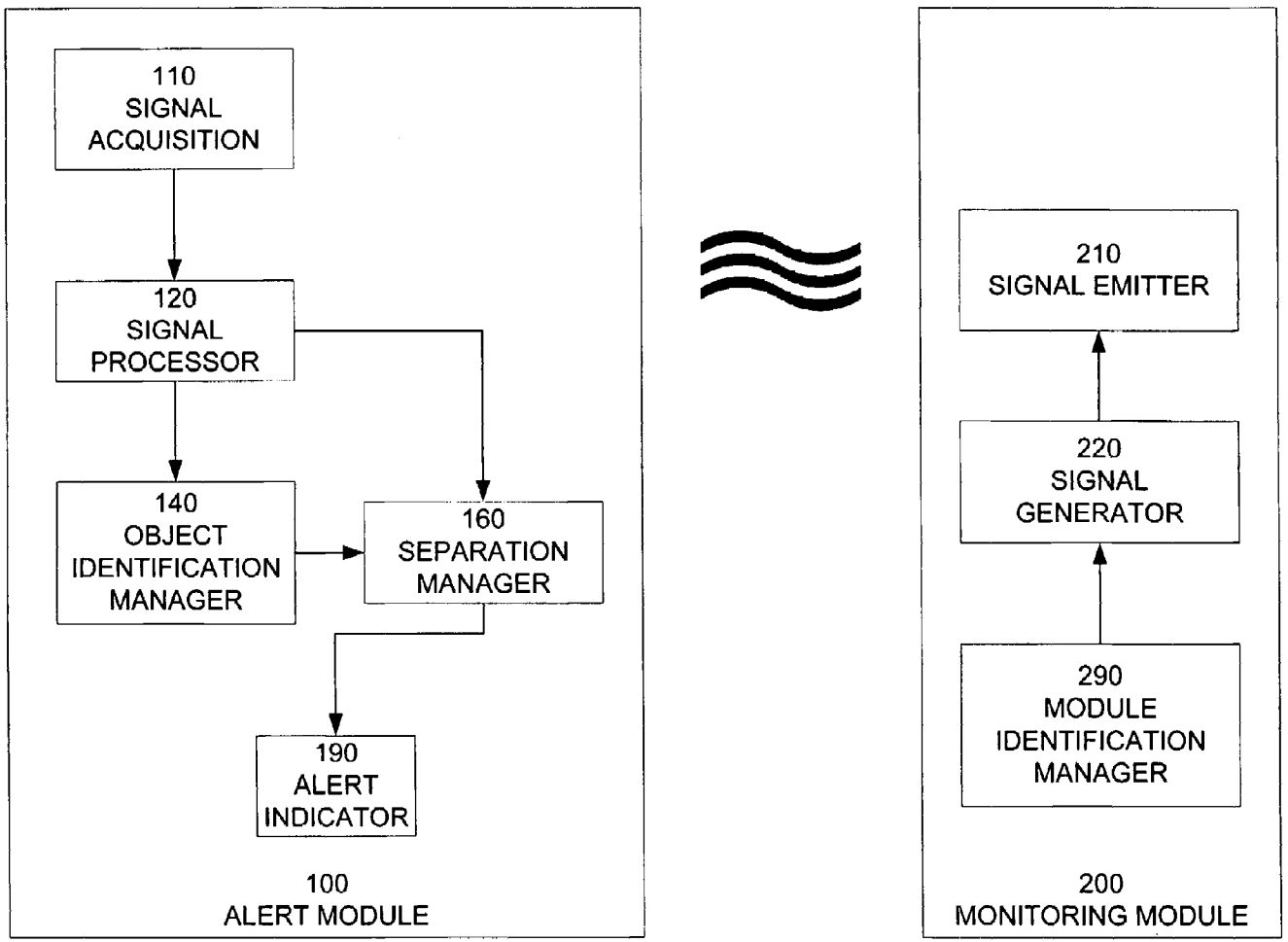
FIG. 1 illustrates the logical elements of a leadless electronic tether according to embodiments of the present invention.

FIG. 1 illustrates the logical elements of a leadless electronic tether according to embodiments of the present invention.

Referring to FIG. 1, an alert module 100 comprises a signal acquisition element 110, a signal processor 120, an object identification manager 140, a separation manager 160 and an alarm 190. The monitoring module 200 comprises a signal emitter 210, a signal generator 220, and module identification manager 290. In an embodiment of the present invention, the signal generator is adapted to emit a burst signal (in contrast to a continuous signal).

Signal acquisition element 110 receives the signal emitted by signal emitter 210. The signal acquisition element 110 comprises a device or devices appropriated to receive the signal generated by the signal generator 220. Signal emitter 210 receives the signal from signal generator 220. The signal comprises a monitoring module identifier provided by module identification manager 290. Referring again to the alert module 100, the signal from the signal acquisition element 110 is received and processed by signal processor 120. The processed signal is sent from signal processor 120 to an object identification manager 140 to obtain the monitoring module identifier. The signal is also provided to separation manager 160 to determine if the distance between the monitoring module and the alert module exceeds a preset separation distance. If the preset separation distance is exceeded, the separation manager sends an alert signal to alert indicator 190. In an embodiment of the present invention, the alert indicator 190 comprises an audible alarm and a visual indicator that identifies the particular monitoring module 200 that has exceed the preset separation distance. By way of illustration and not as a limitation, the visual indicator may be a LED indicator and/or an LCD display. In yet another embodiment, the alert indicator 190 comprises a voice synthesizer that announces that a tagged object has been left behind. Optionally, the tagged object is identified by name or a descriptor.

In an alternate embodiment (not illustrated), the object identification manager 140 and module identification manager 290 are not used. In this embodiment, the alert indicator is an audible alarm.

The logical elements illustrated in FIG. 1 are implemented by various embodiments of the present invention as will be described below. The embodiments described herein are exemplary only and are not intended to limit the present invention. As will be appreciated by those skilled in the art other means may be used to perform the tasks assigned to the logical elements without departing from the scope of the present invention.

Figure 2A:
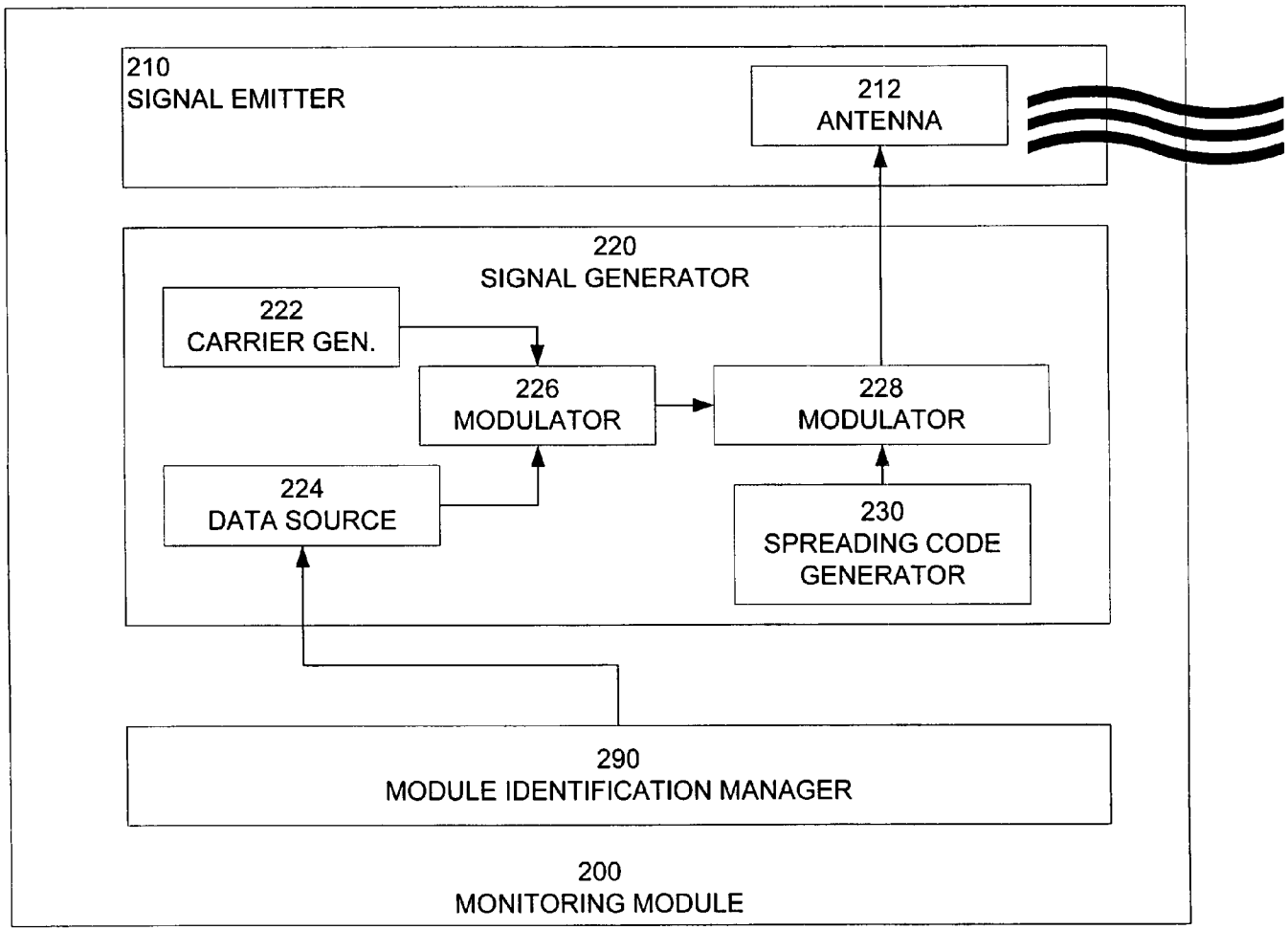
FIGS. 2A and 2B illustrate an electronic tether that uses a spread spectrum signal according to embodiments of the present invention.
Figure 2B:
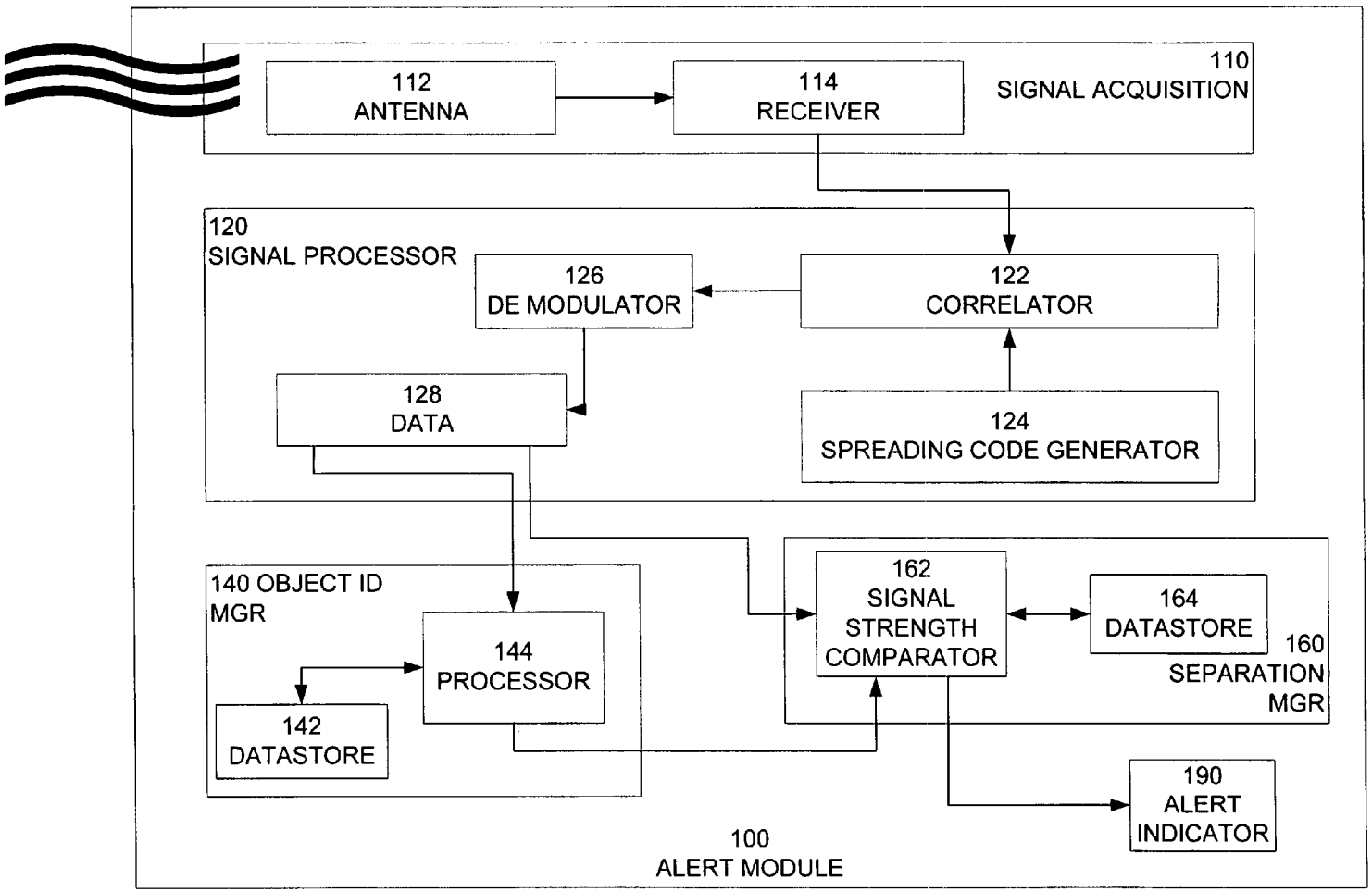

FIGS. 2A and 2B illustrate a leadless electronic tether that uses a spread spectrum signal according to embodiments of the present invention. Referring to FIG. 2A a monitoring module 200 comprises a signal generator 220. Signal generator 220 comprises carrier generator 222 and data source 224. A signal from data source 224 is modulated by modulator 226 using a carrier signal from carrier generator 222. Modulator 228 using a spreading code signal produced by spreading code generator 230 then modulates the modulated data signal. The resulting spread spectrum signal is sent to signal emitter 210 and more specifically to antenna 212.

FIG. 2B illustrates an alert module 100 according to embodiments of the present invention. Signal acquisition element 110 comprises an antenna 112 and a receiver 114. The output of the receiver is a signal that is de-spread by correlator 122 using the same spreading code used by to spread the signal. This spreading code signal is produced by spreading code generator 124. The output of the correlator is demodulated by demodulator 126 to produce the original data stream 128 sent by monitoring module 200. In the case of spread spectrum, the key used for spreading and de-spreading can be used as the primary identification association between the two devices.

The data stream is sent to processor 144 where the module identifier code in the data stream is reconstructed and matched against tagged objects registered in datastore 142. The data stream is also sent to signal strength comparator 162 to determine whether the signal strength has decreased against a baseline stored in datastore 164 for the tagged object identified by the object identification manager 140. If a decrease is detected, the signal strength comparator determines whether the change exceeds a pre-determined threshold. In the event the signal strength has decreased by an amount exceeding the pre-determined threshold, an alert is sent to alert indicator 190.

The monitoring module 200 (FIG. 2A) comprises an address that is maintained by module identification manager 290 and received by data source 224. During an initialization process, object identification manager 140 associates an address of a particular monitoring module 200 with a tagged object (not shown) to which the monitoring module has been physically connected or in which the monitoring module has been incorporated. Referring also to FIG. 2B, during a monitoring session, the object identification manager 140 associates a processed signal from signal processor 120 with the tagged object associated with a particular monitoring module 200.

Prior to initiation of a monitoring session, alert module 100 initializes a signal strength from monitoring module 200. In an embodiment of the present invention, during this initialization process, the alert module 100 is placed at a maximum acceptable separation distance from monitoring module 200. Upon the start of the monitoring session, alert module separation manager receives a monitored signal having a signal strength that is indicative of a distance between the monitoring module and the alert module. If the signal strength of the monitored signal decreases below a threshold value (relative to the maximum separation distance established during initialization), separation manager 160 issues instructions to alert module 190.

Figure 3A:
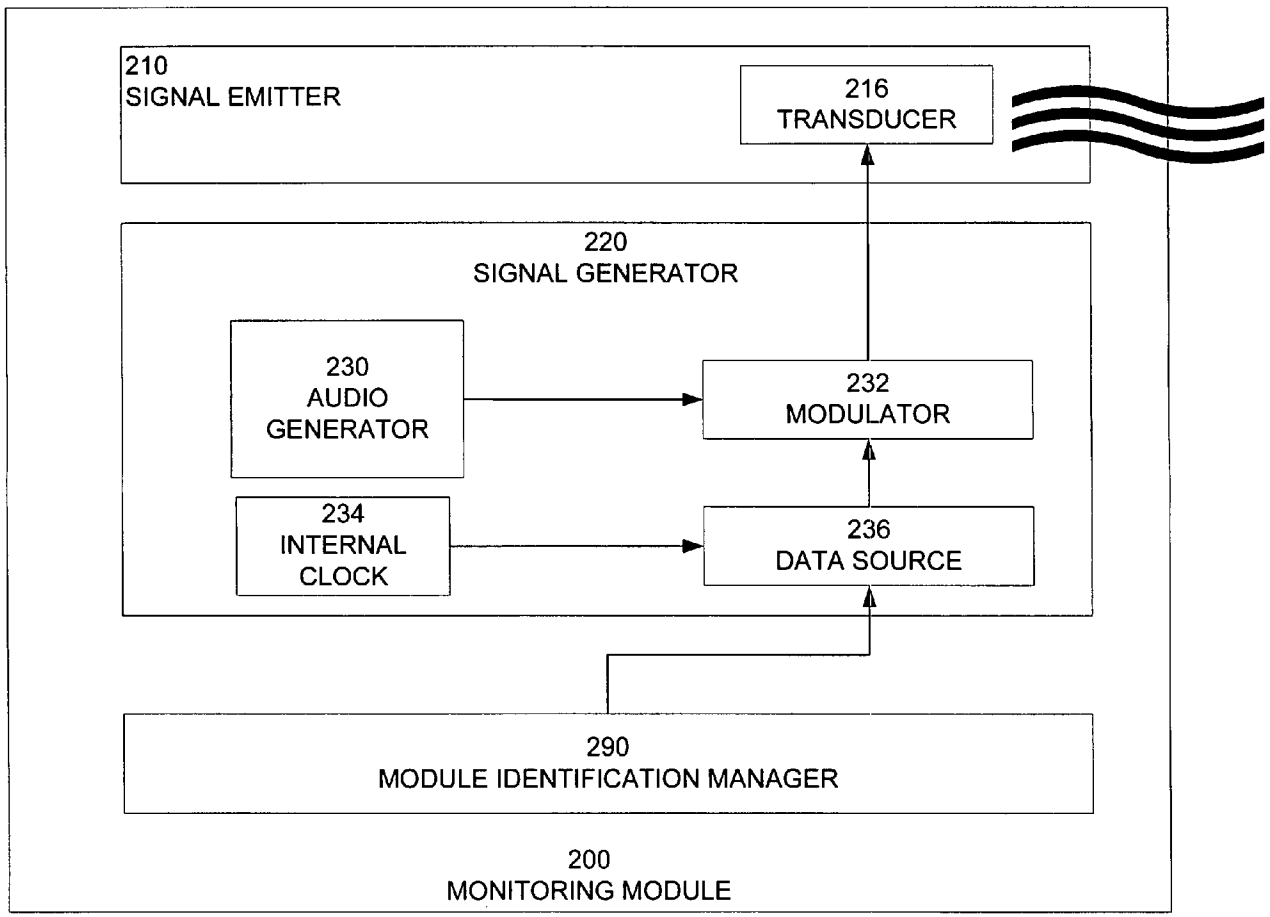
FIGS. 3A and 3B illustrate an electronic tether that uses an audio signal according to embodiments of the present invention.
Figure 3B:
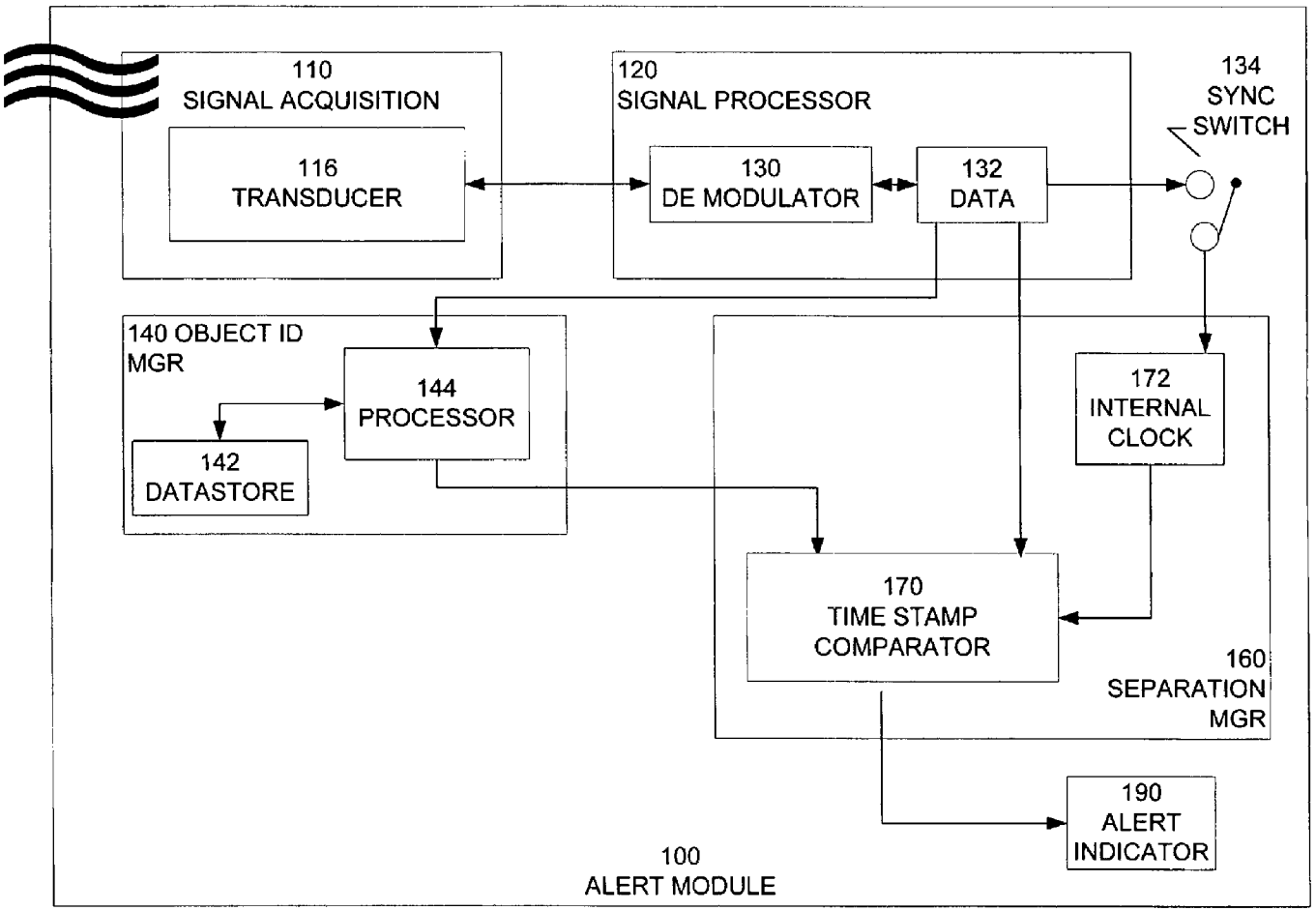

FIGS. 3A and 3B illustrate a leadless electronic tether that uses an audio signal according to embodiments of the present invention. Referring to FIG. 3A, a monitoring module 200 according to embodiments of the present invention is illustrated. A signal generator 220 comprises an audio generator 230, an internal clock 234, a data source 236 and a modulator 232. Modulator 232 receives a high frequency audio carrier from audio generator 230 and modulates the carrier with a data stream received from data source 236. The data stream comprises a monitoring module identifier from module identification manager 290 and a timestamp from internal clock 234. The resultant electrical signal is sent to transducer 216 where it is converted to a high frequency audio signal.

Referring to FIG. 3B, an alert module 100 is illustrated according to embodiments of the present invention. Signal acquisition element 110 comprises a transducer 116 that is adapted to receive the high frequency audio signal and convert that signal to an electrical signal. Signal processor 120 comprises a demodulator 130 demodulates the electrical signal to obtain the information encoded in the audio signal in the form of a data stream 132.

The data stream is sent to processor 144 where the module identifier code in the data stream is reconstructed and matched against tagged objects registered in datastore 142. The data stream is also sent to timestamp comparator 170 to that compares the timestamp of the monitoring module against a baseline timestamp stored in datastore 142 for the tagged object identified by the object identification manager 140.

The monitoring module 200 comprises an address that is maintained by module identification manager 290 and conveyed by signal generator 220 to the alert module 100. During an initialization process, object identification manager 140 associates an address of a particular monitoring module 200 with a tagged object (not shown) to which the monitoring module has been physically connected or in which the monitoring module has been incorporated. During a monitoring session, the object identification manager 140 associates a processed signal from signal processor 120 with the tagged object associated with a particular monitoring module 200.

Separation manager 160 comprises an internal clock. Prior to initiation of a monitoring session, alert module 100 receives an initialization timestamp from monitoring module 200. A clock in separation manager 160 associated with monitoring module 200 is synchronized with the initialization timestamp time via synchronization switch 134. In an embodiment of the present invention, during this synchronization processes, the alert module 100 is place proximate to monitoring module 200 to minimize the transit delay resulting from the passing of the audio signal through space.

The processed signal from signal processor 120 is evaluated by separation manager 160 to determine if a tagged object is no longer within a predetermined distance of the monitoring module. Upon the start of the monitoring session, timestamp comparator 170 receives a current timestamp from monitoring module 200 that reflects the incremental time that has passed since the synchronization process was completed plus the transit time of the audio signal through space. This transit time is reliably indicative of the distance between the monitoring module 200 and the alert module 100. Timestamp comparator 170 subtracts time indicated by the internal clock 172 in separation manager 160 associated with monitoring module 200 from the current timestamp and compares the difference to separation threshold value. If the time difference exceeds the threshold value, timestamp comparator 170 issues instructions to alert indicator 190.

An alternate to a clock in a round trip signal could be a phase-based signal. The received signal would be out of phase with the sent signal by some amount proportional to the distance between them. A similar feature detects relative motion rather than absolute distance using a Doppler effect. Using a tuned reflector on the monitored object, the rate at which the object it is moving towards or away from a sensor is detected. By integrating the relative motion, the approximate separation distance can be computed. Additionally, the fact that the distance between the device and the alert module is increasing may be determined and used to issue an alert.

The embodiments described herein are exemplary only and are not intended to limit the present invention. As will be appreciated by those skilled in the art other means may be used to perform the tasks assigned to the logical elements without departing from the scope of the present invention. By way of illustration and not as a limitation, monitoring module 200 comprises a passive responder that responds with a signal burst when queried by alert module 100. In this embodiment of the present invention, alert module 100 comprises an alerting means that queries monitoring module 200.

Figure 4:
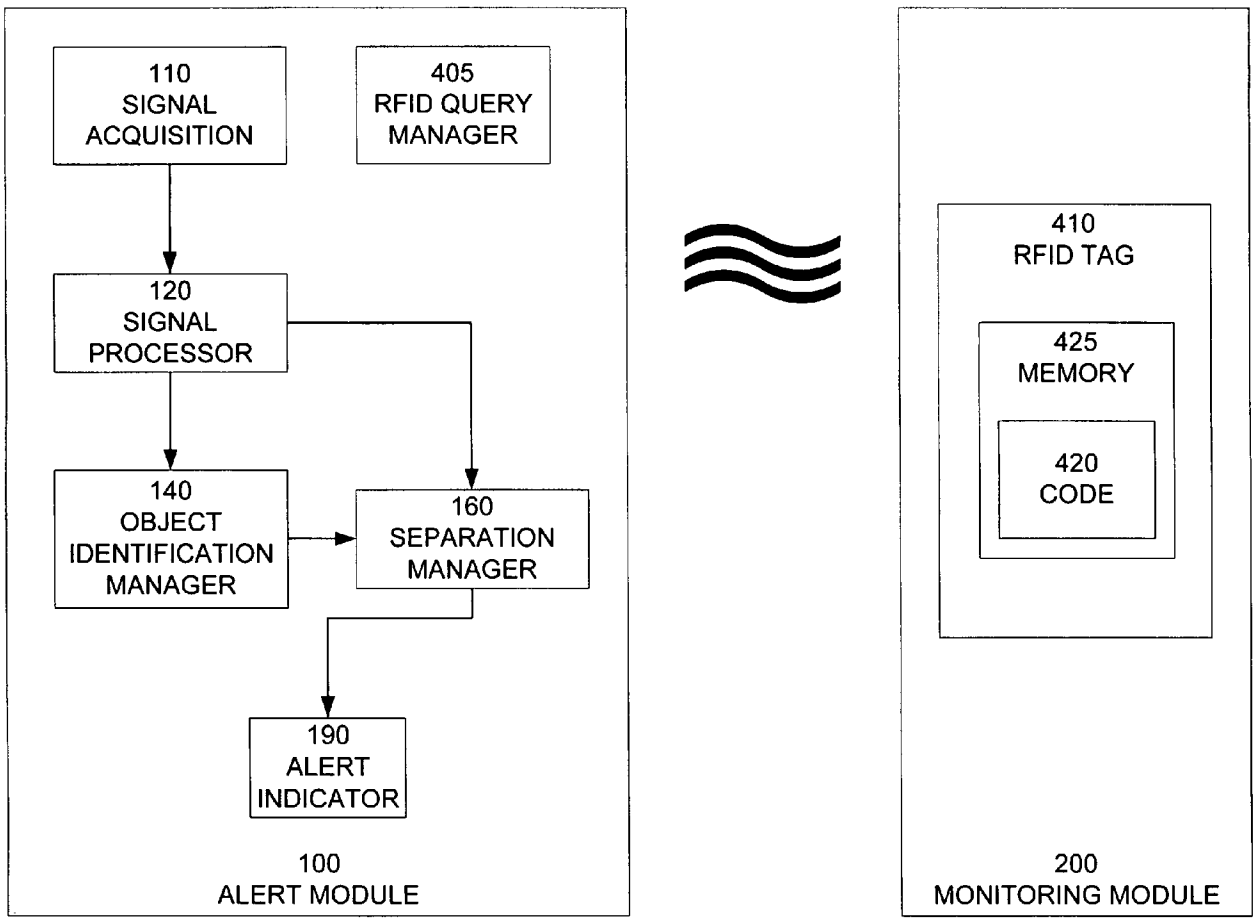
FIG. 4 illustrates the logical elements of a leadless electronic tether utilizing an RFID tag according to embodiments of the present invention.

FIG. 4 illustrates the logical elements of a leadless electronic tether utilizing an RFID tag according to embodiments of the present invention. Referring to FIG. 4, an alert module 100 comprises a signal acquisition element 110, a signal processor 120, an object identification manager 140, a separation manager 160, an alarm 190, and an RFID tag query manager 405. The monitoring module 200 comprises an RFID tag 410. In the embodiment illustrated in FIG. 4, RFID tag 410 is a passive device. However, the present invention is not so limited. Semi-passive or active RFID tags may be utilized in monitoring module 200 without departing from the scope of the present invention. RFID tag 410 comprises memory 415 in which code 420 is stored. Memory 415 may be either a read only memory or programmable read/write memory.

RFID query manager 405 sends a query signal during a preset time period. In another embodiment of the present invention, the power of the query signal sent by query manager 405 may be adjusted. The query signal is received by RFID tag 410 and reflected back to alert module 100. The reflected signal comprises the code 420 stored in memory 415. Signal acquisition element 110 receives the reflected signal emitted by RFID tag 410. The signal acquisition element 110 comprises a device or devices appropriated to receive the signal generated by RFID tag 410. In an embodiment of the present invention, the sensitivity of the signal acquisition element 110 may be adjusted. The reflected signal from the signal acquisition element 110 is received and processed by signal processor 120. The processed signal is sent from signal processor 120 to an object identification manager 140 to obtain the monitoring module identifier. The signal is also provided to separation manager 160 to determine if the distance between the monitoring module and the alert module exceeds a preset separation distance. If the preset separation distance is exceeded, the separation manager sends an alert signal to alert indicator 190. In one embodiment of the present invention, separation manager 160 determines that the preset separation distance has been exceeded based on a lack of a reflected signal from RFID tag 410.

In another embodiment, separation manager 160 uses the signal strength of the reflected signal to determine that the preset separation distance has been exceeded. In conjunction with the variable power of the query signal emitted by query manager 405 and the variable sensitivity of the signal acquisition element 110, the separation distance threshold may be adjusted. As will be appreciated by those skilled in the art, that other means may be used to determine that the preset separation distance has been exceeded without departing from the scope of the present invention.

In an embodiment of the present invention, the alert indicator 190 comprises an audible alarm and a visual indicator that identifies the particular monitoring module 200 that has exceed the preset separation distance. By way of illustration and not as a limitation, the visual indicator may be a LED indicator and/or an LCD display. In yet another embodiment, the alert indicator 190 comprises a voice synthesizer that announces that a tagged object has been left behind. Optionally, the tagged object is identified by name or a descriptor.

Figure 5:
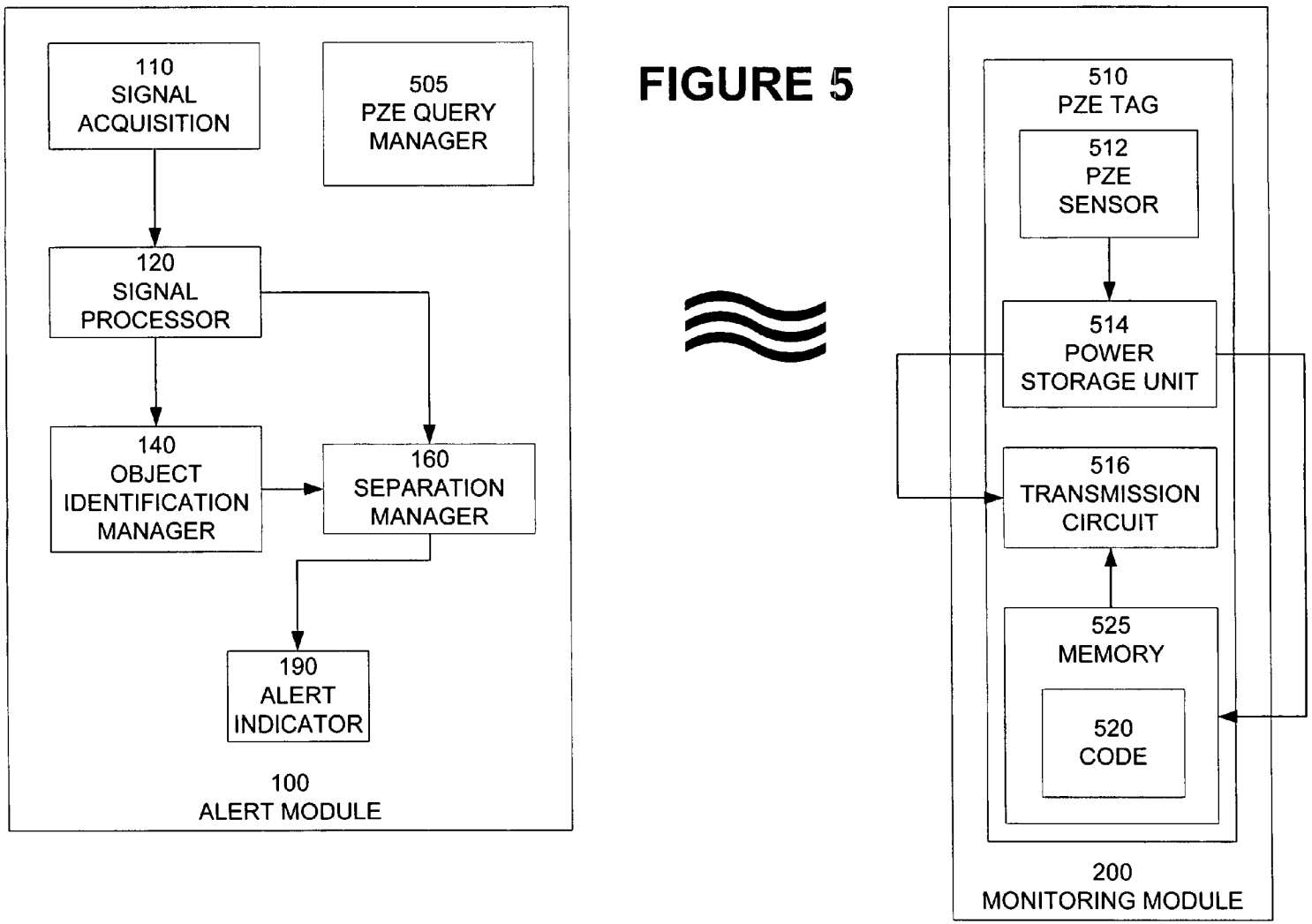
FIG. 5 illustrates the logical elements of a leadless electronic tether utilizing an piezoelectric tag according to an embodiment of the present invention.

While the exemplary embodiment of the present invention described above utilizes RFID tags, the present invention is not so limited. In another embodiment of the present invention as illustrated in FIG. 5, the polling signal is a sonic signal that is directed to a monitoring module 200 comprising a sonic piezoelectric (PZE) sensor 512. The PZE sensor 512 is tuned to the sonic polling signal and produces an electric voltage that is stored in a power storage unit 514. The power storage unit 514 powers a transmission circuit 516 that produces a response signal that is detected and processed by an alert module 100. The power storage unit 514.powers also powers a memory device 525 that comprises an identification code 520. According to an embodiment of the present invention, the transmission circuit 516 generates an RF response signal. In another embodiment of the present invention, the transmission circuit 516 comprises a tuned piezoelectric transducer that produces a sonic response signal that can be distinguished from the sonic polling signal.

An alert module 100 comprises a signal acquisition element 110, a signal processor 120, an object identification manager 140, a separation manager 160, an alarm 190, and an PZE tag query manager 505. The monitoring module 200 comprises the PZE tag 510. In the embodiment illustrated in FIG. 5, PZE tag 510 is a passive device. However, the present invention is not so limited. PZE tag 510 may be powered by power storage unit 514 without departing from the scope of the present invention. Memory 525 may be either a read only memory or programmable read/write memory.

PZE query manager 505 sends a sonic query signal during a preset time period. In another embodiment of the present invention, the power of the query signal sent by query manager 505 may be adjusted. The query signal is received by PZE tag 510 and a response signal is sent from transmission unit 516 to alert module 100. The response signal comprises the code 520 stored in memory 515. Signal acquisition element 110 receives the response signal. The signal acquisition element 110 comprises a device or devices appropriated to receive the signal generated by transmission circuit 516. In an embodiment of the present invention, the sensitivity of the signal acquisition element 110 may be adjusted. The response signal from the signal acquisition element 110 is received and processed by signal processor 120. The processed signal is sent from signal processor 120 to an object identification manager 140 to obtain the monitoring module identifier. The signal is also provided to separation manager 160 to determine if the distance between the monitoring module and the alert module exceeds a preset separation distance. If the preset separation distance is exceeded, the separation manager sends an alert signal to alert indicator 190. In one embodiment of the present invention, separation manager 160 determines that the preset separation distance has been exceeded based on a lack of a response signal from PZE tag 510.

Embodiments of the present invention may be incorporated into other devices without departing from its scope. By way of illustration, an alert module may be incorporated into a cellular telephone, a PDA, a laptop computer, a portable music device, or a wrist watch.

In still another embodiment of the present invention, an alert module is adapted to permit a user to cancel an alert when a monitored object is "released" from monitoring and to provide a second alert when the monitored object again is in proximity to the alert module. For example, a bag may be checked at the airport. When the bag is within a predetermined separation distance of the alert module in the baggage return area of the airport, an alert is issued by the alert module.

The logic for the various functional elements described herein is easily accomplished and known to those skilled in the art. For example, ASIC chips available from Texas Instruments, Fujitsu, Atmel, Thompson, Motorola and Infineon have the capability to be built and programmed to accomplish the functionality described herein. Additionally, design services to build and program ASIC devices are available from Roke Manor Research Limited of Hampshire, United Kingdom, among many others.

Systems and methods for providing an electronic tether have been illustrated. It will be understood by those skilled in the art of the present invention that the systems and methods of the present invention can be used with or without identifying a module. Thus the invention will be useful in providing a simple electronic tether comprising a single alert module and a single monitoring module. Further, although the claims herein discuss the electronic tether in terms of a single monitoring module, this is not meant as a limitation. The present invention anticipates that multiple monitoring modules are to be used in preferred embodiments, the number of which will vary depending on the size of the alert module and production costs. Additionally, the systems and methods may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible.

We claim:

1. An electronic tether comprising:

a monitoring module associated with a monitored object, wherein the monitoring module comprises an RFID tag configured for receiving a polling signal and for transmitting a reflected signal in response to the polling signal, wherein the reflected signal comprises an RFID tag identifier unique to the RFID tag; and an alert module comprising:

a memory comprising the RFID tag identifier;

an RFID tag polling manager comprising instructions for sending the polling signal;

a receiver configured for receiving the reflected signal from the RFID tag;

a separation manager comprising instructions for:

determining whether the reflected signal comprising the RFID tag identifier has been received;

issuing an "object-not-present" signal if the reflected signal comprising the RFID tag has not been received;

in response to the object-not-present signal, identifying the RFID tag as non-responsive;

resending the polling signal; and if the RFID tag identifier is not received after at least one resend attempt, then issuing an object-not-present alert with respect to the non-responsive RFID tag.

2. The electronic tether of claim 1, wherein the object-not-present alert is an audible alarm.

3. The electronic tether of claim 2, wherein the audible alarm is a synthesized voice.

4. The electronic tether of claim 1, wherein the object-not-present alert is a visual alarm.

5. The electronic tether of claim 4, wherein the visual alarm is a text message.

6. The electronic tether of claim 1, wherein the object-not-present alert identifies the monitored object that is associated with the monitoring module.

7. The electronic tether of claim 1, wherein the alert module further comprises instructions for:

accepting an object-not-present alert cancel request from a user;

determining whether a reflected signal comprising the RFID tag identifier has been received; and issuing an object return alert if the reflected signal comprising the RFID tag identifier has been received.

8. The electronic tether of claim 1, wherein the alert module is incorporated into a portable device.

9. The electronic tether of claim 8, wherein the portable device is selected from the group consisting of a cellular telephone, a PDA, a laptop computer, a portable music player, and a wristwatch.

10. The electronic tether of claim 1, wherein the polling manager comprises means for varying the polling signal signal strength, and wherein the alert module further comprises instructions for establishing a preset separation distance between the alert module and the monitoring module by adjusting the polling signal signal strength.

11. The electronic tether of claim 1, wherein the receiver comprises means for varying the receiver sensitivity to the reflected signal, and wherein the alert module further comprises instructions for establishing a preset separation distance between the alert module and the monitoring module by adjusting the receiver sensitivity.

12. The electronic tether of claim 1, wherein a preset separation distance between the alert module and the monitoring module is established by selection of the RFID tag based on a measure of signal strength of the reflected signal.

13. The electronic tether of claim 1, wherein the RFID tag is selected from the group consisting of a passive RFID tag, a semi-passive RFID tag, and an active RFID tag.

14. The electronic tether of claim 1, wherein the alert module further comprises instructions for:

prior to resending the polling signal, increasing the polling signal signal strength by a preset increment;

resending the polling signal; and if the RFID tag identifier is not received after the polling signal signal strength reaches a maximum signal strength level, then issuing the object-not-present alert with respect to the non-responsive RFID tag.

15. The electronic tether of claim 1, wherein the alert module further comprises instructions for:

prior to resending the polling signal, increasing the receiver sensitivity by a preset increment;

resending the polling signal to the non-responsive RFID tag; and if the RFID tag identifier associated with the object is not received after the receiver sensitivity reaches a maximum sensitivity, then issuing the object-not-present alert with respect to the non-responsive RFID tag.

16. A method for monitoring an object using an alert module comprising:

associating an RFID tag identifier with an object and storing the RFID tag identifier in the alert module;

sending a polling signal from the alert module module;

receiving a polling signal at a monitoring module associated with a monitored object, wherein the monitoring module comprises an RFID tag;

transmitting a reflected signal from the RFID tag in response to the polling signal, wherein the reflected signal comprises an identifier unique to the RFID tag;

determining whether a reflected signal from the RFID tag comprising the RFID tag identifier is received at the alert module;

issuing an "object-not-present" signal from the alert module with respect to the object if the RFID tag identifier associated with the object is not received;

in response to the object-not-present signal, identifying the RFID tag as non-responsive; resending the polling signal; and if the RFID tag identifier is not received after at least one resend attempt, then issuing an object-not-present alert with respect to the non-responsive RFID tag.

17. An identification system comprising:

a sonic identification tag, wherein the sonic identification tag comprises a piezoelectric sensor, a power storage unit, a transmission circuit and a tag identifier, and wherein the sonic identification tag is configured for:

receiving a sonic polling signal;

generating an electric current in response to the sonic polling signal;

storing an electric charge in the power storage unit; and sending a response signal from the transmission circuit, wherein the response signal comprises the tag identifier; and an alert module comprising:

a memory comprising the tag identifier;

a sonic polling signal generator, wherein the sonic polling signal generator comprises instructions for sending the polling signal;

a receiver configured for receiving the response signal from the sonic tag;

a separation manager comprising instructions for:

determining whether the response signal comprising the sonic tag identifier has been received; and issuing an "object-not-present" signal if the response signal comprising the sonic tag identifier has not been received, in response to the object-not-present signal, identifying the sonic tag as non-responsive;

resending the polling signal; and if the sonic tag is not received after at least one resend attempt, then issuing an object-not-present alert with respect to the non-responsive sonic tag.

18. The identification system of claim 17, wherein the object-not-present alert is selected from the group consisting of an audible alarm and a visual alarm.

19. The identification system of claim 18, wherein the audible alarm is a synthesized voice.

20. The identification system of claim 17, wherein the object-not-present alert is a visual alarm.

21. The identification system of claim of claim 20, wherein the visual alarm is a text message.

22. The identification system of claim 17, wherein the object-not-present alert identifies the monitored object that is associated with the monitoring module.

23. The identification system of claim 17, wherein the alert module further comprises instructions for:

accepting an object-not-present alert cancel request from a user;

determining whether a reflected signal comprising the sonic tag identifier has been received; and issuing an object return alert if the reflected signal comprising the sonic tag identifier has been received.

24. The identification system of claim 17, wherein the alert module is incorporated into a portable device.

25. The identification system of claim 24, wherein the portable device is selected from the group consisting of a cellular telephone, a PDA, a laptop computer, a portable music player, and a wristwatch.

26. The identification system of claim 17, wherein the alert module further comprises instructions for:

prior to resending the polling signal, increasing the polling signal signal strength by a preset increment;

resending the polling signal; and if the sonic tag identifier is not received after the polling signal signal strength reaches a maximum signal strength level, then issuing the object-not-present alert with respect to the non-responsive sonic tag.

27. The identification system of claim 17, wherein the alert module further comprises instructions for:

prior to resending the polling signal, increasing the receiver sensitivity by a preset increment;

resending the polling signal; and if the sonic tag identifier associated with the object is not received after the receiver sensitivity reaches a maximum sensitivity, then issuing the object-not-present alert with respect to the non-responsive sonic tag.

28. A method of identifying an object comprising:

sending a sonic polling signal from a sonic polling signal generator;

receiving a sonic polling signal at a sonic identification tag;

generating an electric current in response to the sonic polling signal;

storing an electric charge in the power storage unit;

sending a response signal from the transmission circuit, wherein the response signal comprises a sonic tag identifier;

receiving the response signal from sonic identification tag;

determining whether the response signal comprising the sonic tag identifier has been received; and issuing an "object-not-present" signal if the response signal comprising the sonic tag identifier has not been received, in response to the object-not-present signal, identifying the sonic tag as non-responsive;

resending the polling signal; and if the sonic tag identifier is not received after at least one resend attempt, then issuing an object-not-present alert with respect to the non-responsive sonic tag.

29. An electronic tether comprising:

a first monitoring module comprising a first RFID tag and a second monitoring module comprising a second RFID tag, wherein the first RFID tag is configured to receive a polling signal and to transmit a first reflected signal in response to the polling signal and wherein the second RFID tag is configured to receive the polling signal and to transmit a second reflected signal in response to the polling signal, and wherein the first reflected signal comprises an first identifier unique to the first RFID tag and the second reflected signal comprises an second identifier unique to the second RFID tag; and an alert module comprising:

a memory comprising the first and second RFID tag identifiers;

an RFID tag polling manager comprising instructions for sending the polling signal;

a receiver configured for receiving the first and second reflected signals from the first and second RFID tags;

a separation manager comprising instructions for:

determining whether the first reflected signal comprising the first RFID tag identifier has been received;

issuing a first "object-not-present" signal with respect to the first alert module if the first reflected signal comprising the first RFID tag has not been received;

in response to the first object-not-present signal, identifying the first RFID tag as non-responsive;

determining whether the second reflected signal comprising the second RFID tag identifier has been received;

issuing a second "object-not-present" signal with respect to the second alert module if the second reflected signal comprising the second RFID tag has not been received;

in response to the second object-not-present signal, identifying the second RFID tag as non-responsive;

if either the first or second RFID tags have been identified as non-responsive, then resending the polling signal;

if the first RFID tag identifier is not received after at least one resend attempt, then issuing a first object-not-present alert with respect to the first non-responsive RFID tag; and if the second RFID tag identifier is not received after at least one resend attempt, then issuing a second object-not-present alert with respect to the second non-responsive RFID tag.

30. The electronic tether of claim 29, wherein the first object-not-present alert and the second not present alert is an audible alarm.

31. The electronic tether of claim 30, wherein the audible alarm is a synthesized voice.

32. The electronic tether of claim 29, wherein the first object-not-present alert and second not present alert are visual alarms.

33. The electronic tether of claim 32, wherein a visual alarm is a text message.

34. The electronic tether of claim 29, wherein the first object-not-present alert identifies the monitored object that is associated with the first monitoring module.

35. The electronic tether of claim 29, wherein the alert module further comprises instructions for:

accepting a first object-not-present alert cancel request from a user with respect to the first alert module;

determining whether a first reflected signal comprising the first RFID tag identifier has been received; and issuing an object return alert with respect to the first alert module if the first reflected signal comprising the first RFID tag identifier has been received.

36. The electronic tether of claim 29, wherein the alert module is incorporated into a portable device.

37. The electronic tether of claim 36, wherein the portable device is selected from the group consisting of a cellular telephone, a PDA, a laptop computer, a portable music player, and a wristwatch.

38. The electronic tether of claim 29, wherein the polling manager comprises means for varying the polling signal signal strength and wherein the alert module further comprises instructions for establishing a preset separation distance between the alert module and the first and second monitoring modules by adjusting the polling signal signal strength.

39. The electronic tether of claim 29, wherein the receiver comprises means for varying the receiver sensitivity to the reflected signal and wherein the alert module further comprises instructions for establishing a preset separation distance between the alert module and the first and second monitoring modules by adjusting the receiver sensitivity.

40. The electronic tether of claim 29, wherein the at least first and second RFID tags are selected from the group consisting of a passive RFID tag, a semi-passive RFID tag, and an active RFID tag.

41. The electronic tether of claim 29, wherein the alert module is further comprises instructions for:

prior to resending the polling signal, increasing the polling signal signal strength by a preset increment; resending the polling signal if the first RFID tag identifier is not received after the polling signal signal strength reaches a maximum signal strength level, then issuing the object-not-present alert with respect to the first non-responsive RFID tag; and if the second RFID tag identifier is not received after the polling signal signal strength reaches the maximum signal strength level, then issuing a second object-not-present alert with respect to the second non-responsive RFID tag.

42. The electronic tether of claim 29, wherein the alert module is further adapted to:

prior to resending the polling signal, increasing the receiver sensitivity by a preset increment;

resending the polling signal;

if the first RFID tag identifier is not received after the receiver sensitivity reaches a maximum sensitivity, then issuing the object-not-present alert with respect to the first non-responsive RFID tag; and if the second RFID tag identifier is not received after the receiver sensitivity reaches the maximum sensitivity, then issuing a second object-not-present alert with respect to the second non-responsive RFID tag.

43. The electronic tether of claim 29, wherein:

a first preset preset separation distance is established by selection of the first RFID tag based on a measure of signal strength of the reflected signal of the first RFID tag; and a second preset preset separation distance is established by selection of the RFID tag based on a measure of signal strength of the reflected signal of the second RFID tag.

* * * * *